US011247861B2

(12) United States Patent
Arai et al.

(10) Patent No.: US 11,247,861 B2
(45) Date of Patent: Feb. 15, 2022

(54) MEDIUM CONVEYING APPARATUS FOR DETERMINING THICKNESS OF MEDIUM

(71) Applicant: PFU LIMITED, Kahoku (JP)

(72) Inventors: Yuta Arai, Kahoku (JP); Shingo Kanaya, Kahoku (JP)

(73) Assignee: PFU LIMITED, Kahoku (JP)

( * ) Notice: Subject to any disclaimer, the term of this patent is extended or adjusted under 35 U.S.C. 154(b) by 294 days.

(21) Appl. No.: 16/667,478

(22) Filed: Oct. 29, 2019

(65) Prior Publication Data

US 2020/0299086 A1 Sep. 24, 2020

(30) Foreign Application Priority Data

Mar. 20, 2019 (JP) ..... JP2019-053560

(51) Int. Cl.
*B65H 7/02* (2006.01)
*B65H 5/06* (2006.01)
*B65H 7/20* (2006.01)

(52) U.S. Cl.
CPC ..... *B65H 7/02* (2013.01); *B65H 5/06* (2013.01); *B65H 5/062* (2013.01); *B65H 7/20* (2013.01); *B65H 2511/13* (2013.01); *B65H 2701/1125* (2013.01)

(58) Field of Classification Search
CPC . B65H 5/00; B65H 5/06; B65H 5/062; B65H 5/066; B65H 7/00; B65H 7/02; B65H 7/12; B65H 7/20; B65H 2511/13; B65H 2513/10; B65H 2513/102; B65H 2513/104; B65H 2701/1125; B65H 2801/39
See application file for complete search history.

(56) References Cited

U.S. PATENT DOCUMENTS

2013/0134665 A1 5/2013 Asano et al.
2016/0090256 A1* 3/2016 Nakayama ..... B65H 7/14 271/265.04
2019/0344985 A1* 11/2019 Aoki ..... B65H 3/0669

FOREIGN PATENT DOCUMENTS

JP 2013-136454 A 7/2013

* cited by examiner

*Primary Examiner* — Prasad V Gokhale
(74) *Attorney, Agent, or Firm* — Lewis Roca Rothgerber Christie LLP

(57) ABSTRACT

A medium conveying apparatus includes a conveyance roller to convey a medium, a motor to drive the conveyance roller, a signal generator to output a pulse signal, a pulse width of which changes according to a rotation speed of the motor, and a processor to rotate the conveyance roller by controlling the motor, and detect a fluctuation of the pulse width caused by a load fluctuation when the conveyance roller conveys a medium to determine a thickness of the medium according to the pulse width.

20 Claims, 12 Drawing Sheets

MEDIUM CONVEYING APPARATUS FOR DETERMINING THICKNESS OF MEDIUM

CROSS-REFERENCE TO RELATED APPLICATION

This application is based upon and claims the benefit of priority of prior Japanese Patent Application No. 2019-053560 filed on Mar. 20, 2019, the entire contents of which are incorporated herein by reference.

FIELD

Embodiments discussed in the present specification relate to medium conveyance.

BACKGROUND

Since a thickness of a sheet forming an image in a copying machine affects an image formation condition, there is a demand for finding out a thickness of a sheet before forming an image.

For example, a sheet conveying apparatus described in Japanese Patent Application Laid-Open No. 2013-136454 includes a conveyance roller provided on an internal circumference side of a part where a conveyance path of a sheet is crooked, a driving means driving rotation of the conveyance roller, and a drive control means controlling a rotation speed of the conveyance roller through the driving means. Then, the sheet conveying apparatus detects a thickness of a sheet on the basis of a conveyance speed of the sheet, a radius of the conveyance roller, and a rotation speed of the conveyance roller.

SUMMARY

According to some embodiments, a medium conveying apparatus includes a conveyance roller to convey a medium, a motor to drive the conveyance roller, a signal generator to output a pulse signal, a pulse width of which changes according to a rotation speed of the motor, and a processor to rotate the conveyance roller by controlling the motor, and detect a fluctuation of the pulse width caused by a load fluctuation when the conveyance roller conveys a medium to determine a thickness of the medium according to the pulse width.

According to some embodiments, a method for determining a thickness of a medium includes rotating a conveyance roller to convey a medium by controlling a motor to drive the conveyance roller, outputting a pulse signal, a pulse width of which changes according to a rotation speed of the motor, detecting a fluctuation of the pulse width caused by a load fluctuation when the conveyance roller conveys the medium, and determining a thickness of the medium according to the pulse width.

According to some embodiments, a computer program causes a medium conveying apparatus including a conveyance roller to convey a medium, a motor to drive the conveyance roller, a signal generator to output a pulse signal, a pulse width of which changes according to a rotation speed of the motor, to execute a process including rotating the conveyance roller by controlling the motor, detecting a fluctuation of the pulse width caused by a load fluctuation when the conveyance roller conveys the medium, and determining a thickness of the medium according to the pulse width.

DESCRIPTION OF EMBODIMENTS

It is to be understood that both the foregoing general description and the following detailed description are exemplary and explanatory, and are not restrictive of the invention, as claimed.

Hereinafter, medium conveying apparatus, and method according to an embodiment, will be described with reference to the drawings. However, it should be noted that the technical scope of the invention is not limited to these embodiments, and extends to the inventions described in the claims and their equivalents.

Figure 1:
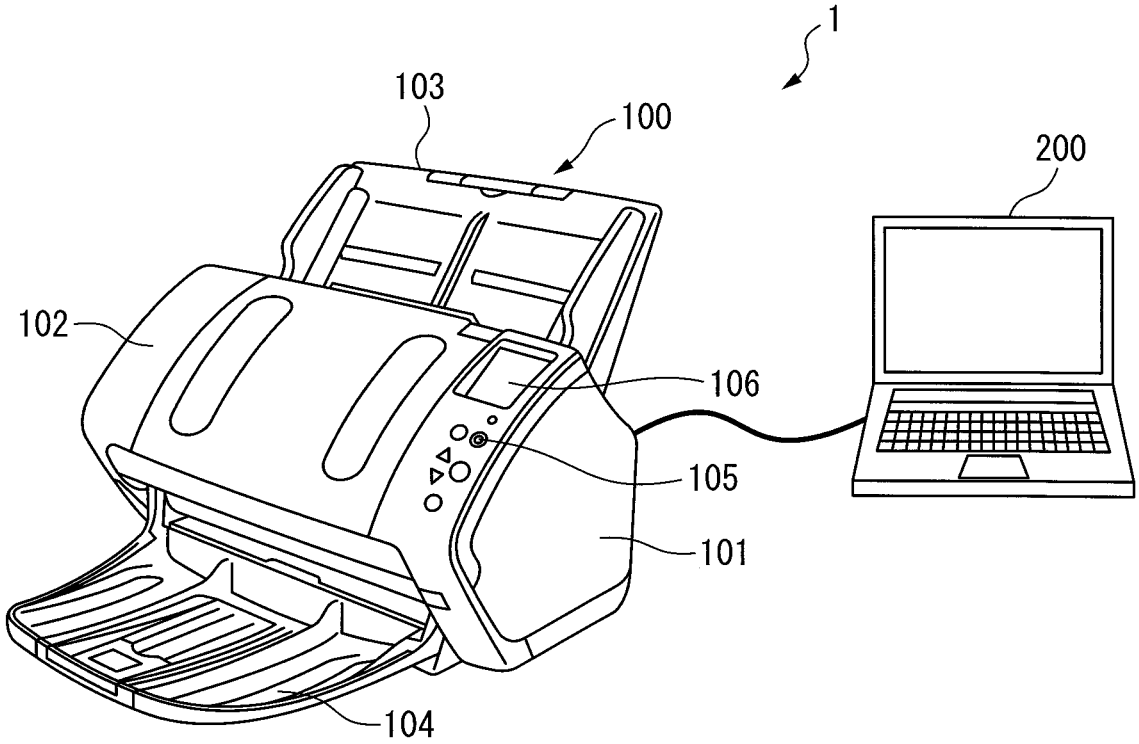
FIG. 1 is a configuration diagram of an example of an image processing system 1 according to an embodiment.

FIG. 1 is a configuration diagram of an example of an image processing system 1 according to an embodiment. The image processing system 1 includes a medium conveying apparatus 100 and an information processing apparatus 200.

The medium conveying apparatus 100 is an image scanner or the like imaging an image of a medium while conveying the medium. A medium is paper, thick paper, a card, a brochure, a passport, or the like. The medium conveying apparatus 100 may be a facsimile, a copying machine, a multifunctional peripheral (MFP), or the like. A conveyed medium may be an object being printed on or the like rather than an original, and the medium conveying apparatus 100 may be a printer or the like. The information processing apparatus 200 is a server, a personal computer, a multifunctional mobile terminal, a mobile phone, or the like. The medium conveying apparatus 100 and the information processing apparatus 200 are connected to one another.

The medium conveying apparatus 100 includes a lower housing 101, an upper housing 102, a loading tray 103, an output tray 104, an operation device 105, and a display device 106.

The upper housing 102 is an example of an upper part of a housing, is located in a position covering a top surface of the medium conveying apparatus 100, and is engaged with the lower housing 101 by a hinge in such a way as to be able to open and close in a case of a medium being stuck, cleaning inside the medium conveying apparatus 100, or the like.

The loading tray 103 is formed by a resin member and is engaged with the lower housing 101 in such a way as to be able to place a medium to be conveyed. The loading tray 103 is provided in such a way that a placement surface of a medium is tilted against an installation surface of the medium conveying apparatus 100. The output tray 104 is engaged with the lower housing 101 in such a way as to be able to hold an ejected medium.

The operation device 105 includes an input device, such as a button, and an interface circuit acquiring a signal from the input device, receives an input operation by a user, and outputs an operation signal based on the input operation by the user. The display device 106 includes a display including a liquid crystal or organic electro-luminescence (EL), and an interface circuit outputting image data to the display, and displays the image data on the display.

Figure 2:
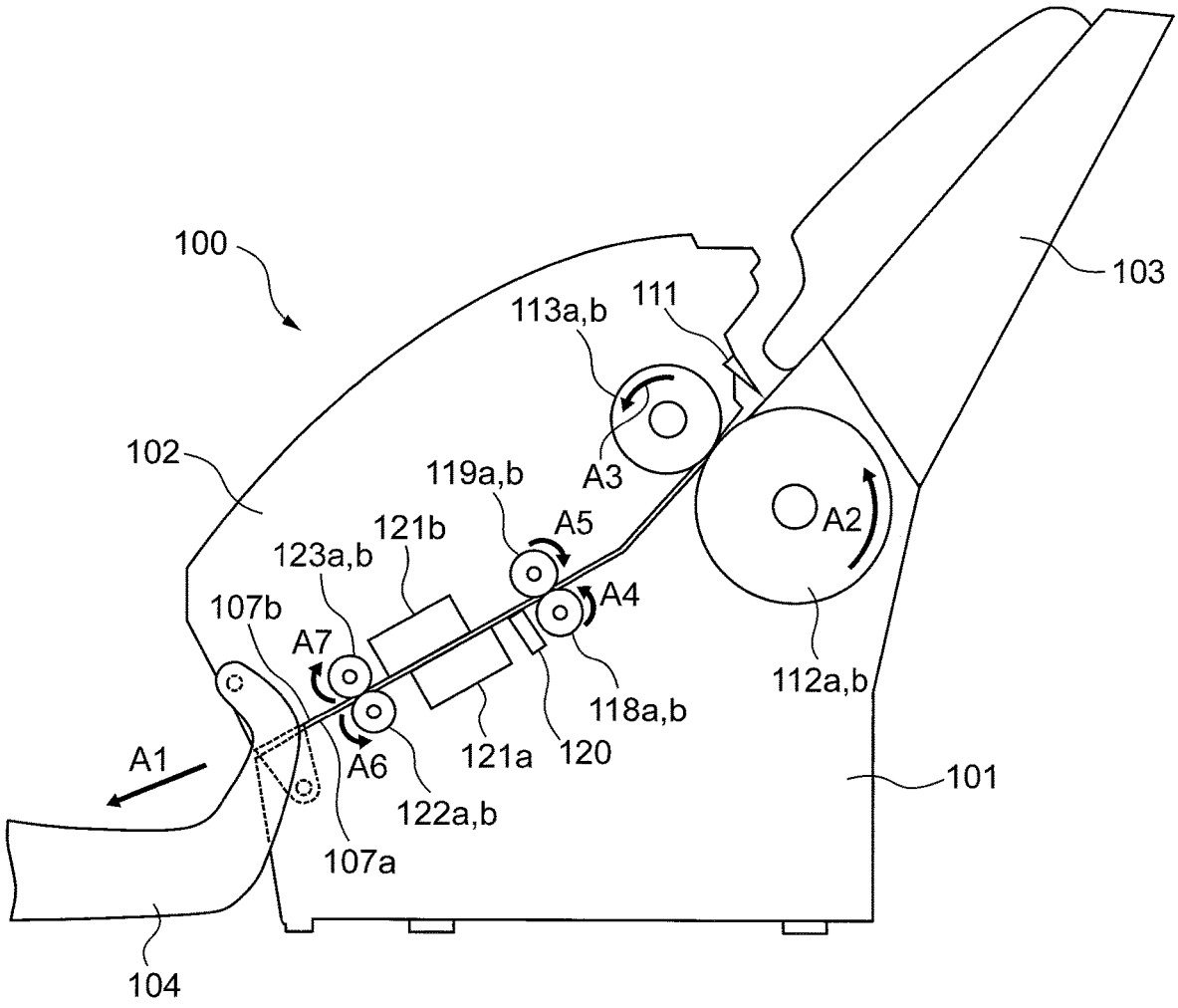
FIG. 2 is a diagram for illustrating a conveyance path inside a medium conveying apparatus 100.

FIG. 2 is a diagram for illustrating a conveyance path inside the medium conveying apparatus 100.

The conveyance path inside the medium conveying apparatus 100 includes a first medium detection sensor 111, a plurality of feed rollers 112*a* and *b*, a plurality of brake rollers 113*a* and *b*, a plurality of first conveyance rollers 118*a* and *b*, a plurality of second conveyance rollers 119*a* and *b*, a second medium detection sensor 120, a first imaging device 121*a*, a second imaging device 121*b*, a plurality of third conveyance rollers 122*a* and *b*, and a plurality of fourth conveyance rollers 123*a* and *b*.

The feed rollers 112*a* and 112*b* may be hereinafter collectively referred to as feed rollers 112. Further, the brake rollers 113*a* and 113*b* may be collectively referred to as brake rollers 113. Further, the first conveyance rollers 118*a* and 118*b* may be collectively referred to as first conveyance rollers 118. Further, the second conveyance rollers 119*a* and 119*b* may be collectively referred to as second conveyance rollers 119. Further, the first imaging device 121*a* and the second imaging device 121*b* may be collectively referred to as imaging devices 121. Further, the third conveyance rollers 122*a* and 122*b* may be collectively referred to as third conveyance rollers 122. Further, the fourth conveyance rollers 123*a* and 123*b* may be collectively referred to as fourth conveyance rollers 123.

A top surface of the lower housing 101 forms a lower guide 107*a* of a medium conveyance path, and a bottom surface of the upper housing 102 forms an upper guide 107*b* of the medium conveyance path. An upper stream of the medium conveyance path hereinafter refers to an upper stream in a medium conveying direction A1, and a lower stream refers to a lower stream in the medium conveying direction A1.

The first medium detection sensor 111 is located on the upstream side of the feed rollers 112 and the brake rollers 113. The first medium detection sensor 111 includes a contact detection sensor and detects whether or not a medium is placed on the loading tray 103. The first medium detection sensor 111 generates and outputs a medium detection signal changing the signal value between a state in which a medium is placed on the loading tray 103 and a state in which a medium is not placed.

The feed rollers 112 are provided on the lower housing 101 and sequentially feed media placed on the loading tray 103 from the lower side. The brake rollers 113 are provided on the upper housing 102 and are located to face the feed rollers 112.

The first imaging device 121*a* is an example of an imaging device and includes a reduction optical system type line sensor including an imaging element based on charge coupled devices (CCDs) linearly located in a main scanning direction orthogonal to the medium conveying direction A1. Further, the first imaging device 121*a* includes a lens forming an image on the imaging element and an A/D converter amplifying and analog-digital (A/D) converting an imaging signal output from the imaging element. The first imaging device 121*a* generates and outputs an input image in which a back side of a conveyed medium is imaged, in accordance with control from a processing circuit to be described later.

Similarly, the second imaging device 121*b* is an example of an imaging device and includes a reduction optical system type line sensor including an imaging element based on CCDs linearly located in the main scanning direction. Further, the second imaging device 121*b* includes a lens forming an image on the imaging element and an A/D converter amplifying and analog-digital (A/D) converting an imaging signal output from the imaging element. The second imaging device 121*b* generates and outputs an input image in which a front side of a conveyed medium is imaged, in accordance with control from the processing circuit to be described later.

Only either of the first imaging device 121*a* and the second imaging device 121*b* may be located in the medium conveying apparatus 100, and only one side of a medium may be read. Further, a unity-magnification optical system type contact image sensor (CIS) including an imaging element based on a complementary metal oxide semiconductor (CMOS) may be used in place of the imaging element based on CCDs.

A medium placed on the loading tray 103 is conveyed between the lower guide 107*a* and the upper guide 107*b* in the medium conveying direction A1 by the feed rollers 112 rotating in a direction A2 in FIG. 2, that is, a medium feeding direction. When a medium is conveyed, the brake rollers 113 rotate in a direction A3, that is, a direction opposite to the medium feeding direction. By the workings of the feed rollers 112 and the brake rollers 113, when a plurality of media are placed on the loading tray 103, only a medium in contact with the feed rollers 112, out of the media placed on the loading tray 103, is separated. Consequently, the medium conveying apparatus 100 operates in such a way that conveyance of a medium other than the separated medium is restricted (prevention of multi feed).

A medium is fed between the first conveyance rollers 118 and the second conveyance rollers 119 while being guided by the lower guide 107*a* and the upper guide 107*b*. The medium is fed between the first imaging device 121*a* and the second imaging device 121*b* by the first conveyance rollers 118 and the second conveyance rollers 119 rotating in a direction A4 and a direction A5, respectively. The medium read by the imaging devices 121 is ejected on the output tray 104 by the third conveyance rollers 122 and the fourth conveyance rollers 123 rotating in a direction A6 and a direction A7, respectively. The first conveyance rollers 118, the second conveyance rollers 119, the third conveyance rollers 122, and the fourth conveyance rollers 123 are examples of a conveyance roller that conveys a medium.

Figure 3:
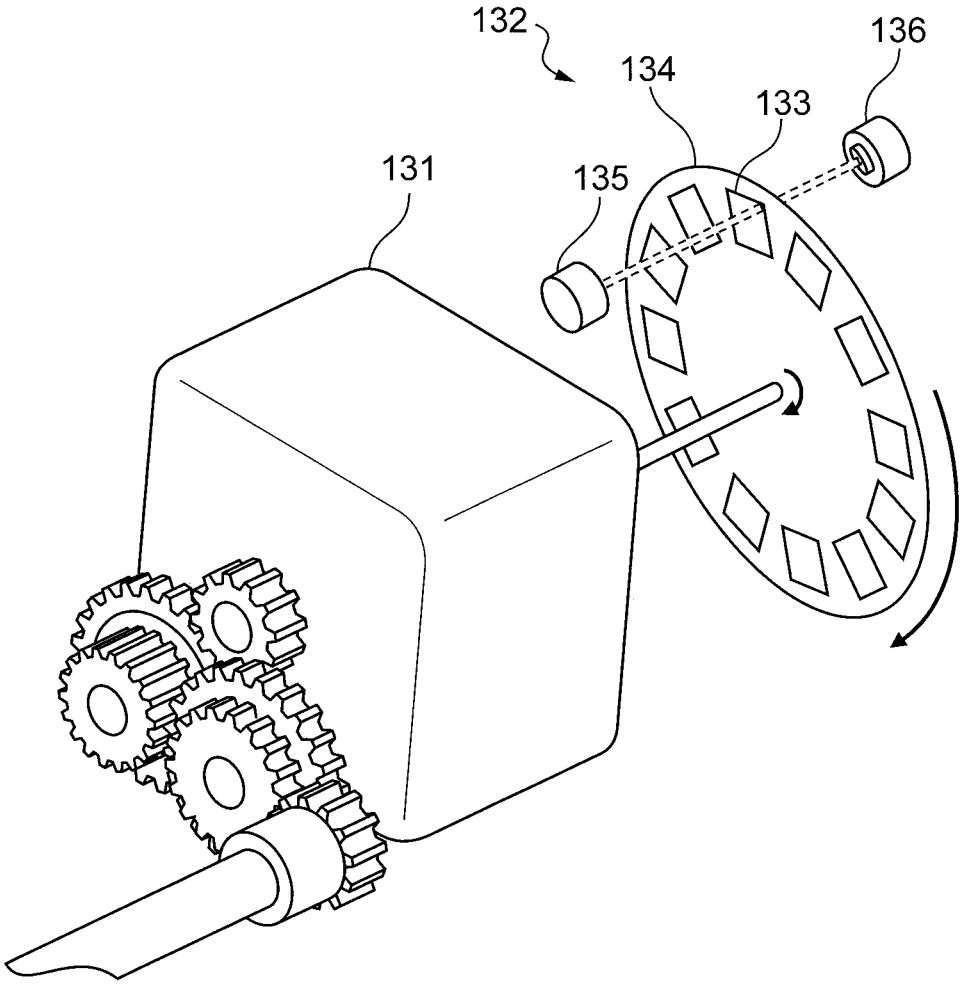
FIG. 3 is a diagram schematically illustrating an example of a waveform of a pulse signal output from an encoder 132 for measuring a rotation speed of a motor 131.
Figure 3:
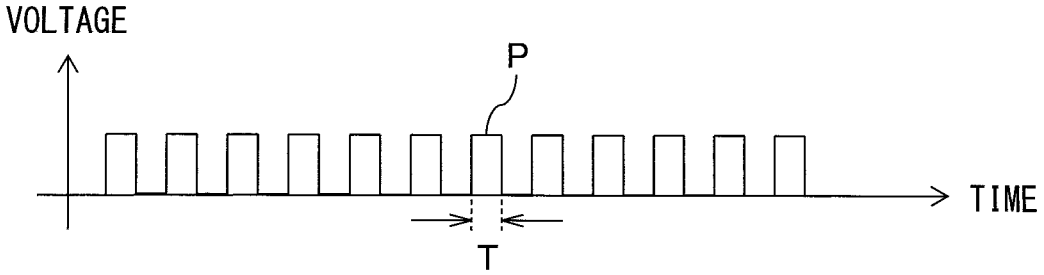

FIG. 3 is a diagram schematically illustrating an example of a waveform of a pulse signal output from an encoder 132 for measuring a rotation speed of a motor 131. The encoder 132 is an example of a signal generator.

The motor 131 performs a conveyance operation of a medium by rotating the first conveyance rollers 118, the second conveyance rollers 119, the third conveyance rollers 122, and the fourth conveyance rollers 123. The encoder 132 outputs a pulse signal P a pulse width T of which changes according to a rotation speed of the motor 131. For example, an optical encoder includes a disk 134 on which a large number of slits 133 (light transmission holes) are formed, the disk 134 being provided to rotate according to rotation of the motor 131, and a light emitter 135 and a light receiver 136 that are provided to face one another with the disk 134 in between.

For example, the encoder 132 schematically illustrated in FIG. 3 outputs a relatively large signal value (High) while the light receiver 136 receives light emitted by the light emitter 135 from a slit 133 and outputs a relatively small signal value (Low) while light emitted by the light emitter 135 is blocked by the disk 134. In other words, the pulse width T of the pulse signal P indicates a length of a period in which a slit 133 exists between the light emitter 135 and the light receiver 136 and changes according to a rotation speed of the motor 131. FIG. 3 illustrates a disk 134 including 12 slits 133 for convenience; however, an actual disk 134 includes several hundred slits 133.

Figure 4:
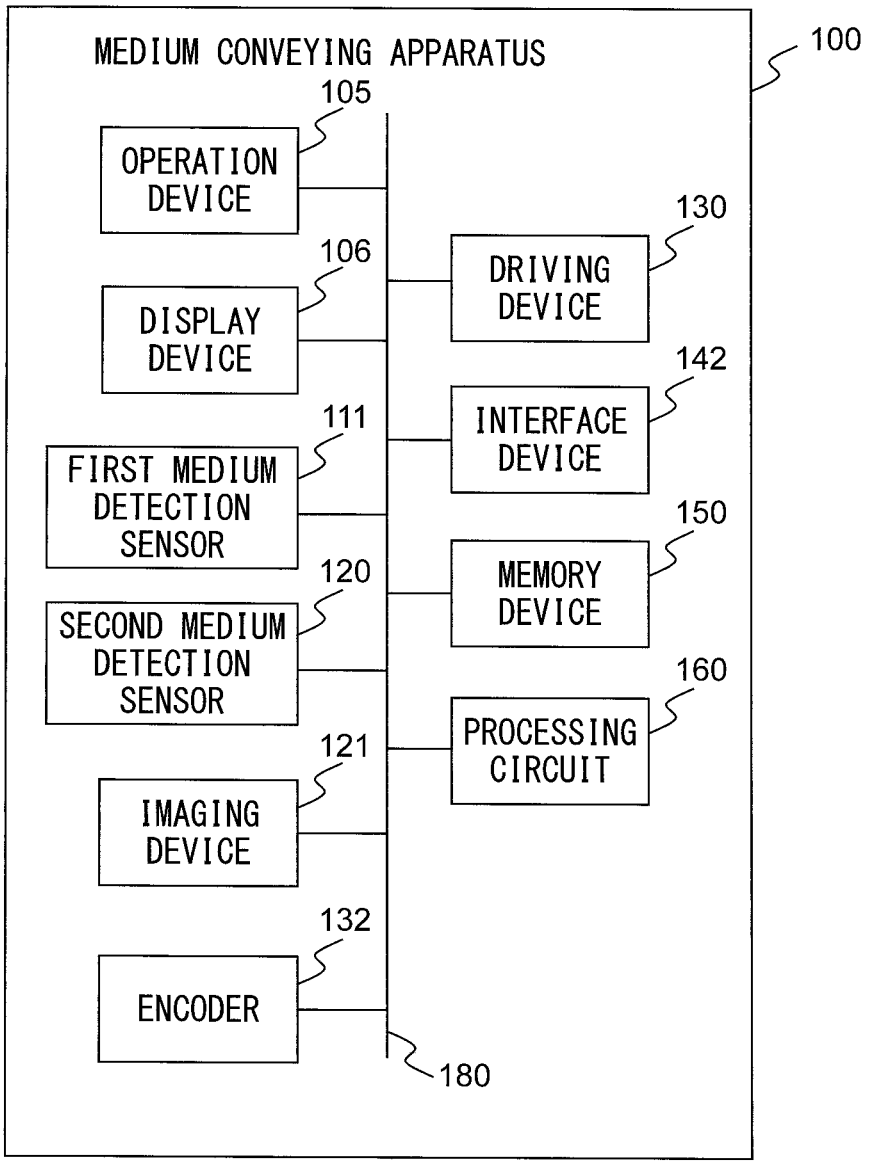
FIG. 4 is a block diagram illustrating a schematic configuration of the medium conveying apparatus 100.

FIG. 4 is a block diagram illustrating a schematic configuration of the medium conveying apparatus 100.

The medium conveying apparatus 100 further includes a driving device 130, an interface device 142, a memory device 150, and a processing circuit 160 in addition to the configuration described above.

The driving device 130 drives the motor 131 in accordance with a control signal from the processing circuit 160 and conveys a medium by rotating the feed rollers 112, the first conveyance rollers 118, the second conveyance rollers 119, the third conveyance rollers 122, and the fourth conveyance rollers 123. The driving device 130 may cause separate motors to rotate the feed rollers 112, the first conveyance rollers 118, the second conveyance rollers 119, the third conveyance rollers 122, and the fourth conveyance rollers 123, respectively.

For example, the interface device 142 includes an interface circuit conforming to a serial bus such as USB, is electrically connected to the information processing apparatus 200, and transmits and receives an input image and various types of information. Further, a communication unit including an antenna transmitting and receiving wireless signals, and a wireless communication interface device for transmitting and receiving signals through a wireless communication line in conformance with a predetermined communication protocol may be used in place of the interface device 142. For example, the predetermined communication protocol is a wireless local area network (LAN).

The memory device 150 includes a memory device such as a random access memory (RAM) or a read only memory (ROM), a fixed disk device such as a hard disk, or a portable storage device such as a flexible disk or an optical disk. Further, the memory device 150 stores a computer program, a database, a table, and the like used for various types of processing in the medium conveying apparatus 100. The computer program may be installed on the memory device 150 from a computer-readable portable recording medium by use of a known setup program or the like. For example, the portable recording medium is a compact disc read only memory (CD-ROM), a digital versatile disc read only memory (DVD-ROM), or the like.

For example, the processing circuit 160 is a processor, such as a central processing unit (CPU). The processing circuit 160 operates in accordance with a program previously stored in the memory device 150. The processing circuit 160 may be a digital signal processor (DSP), a large scale integration (LSI), an application specific integrated circuit (ASIC), a field-programmable gate array (FPGA), etc.

The processing circuit 160 is connected to the operation device 105, the display device 106, the first medium detection sensor 111, the second medium detection sensor 120, the imaging devices 121, the encoder 132, the driving device 130, the interface device 142, the memory device 150, the processing circuit 170, and the like through a bus 180, and controls each of these units. The processing circuit 160 performs drive control of the driving device 130, imaging control of the imaging devices 121, and the like, acquires an input image, and transmits the input image to the information processing apparatus 200 through the interface device 142.

The processing circuit 160 receives signals output from the first medium detection sensor 111, the second medium detection sensor 120, and the encoder 132 through the bus 180. While each of the first medium detection sensor 111, the second medium detection sensor 120, and the encoder 132 includes an analog-digital conversion circuit, an analog-digital conversion circuit may be provided between the respective sensors and the processing circuit 160.

The processing circuit 170 executes predetermined image processing on an image imaged by the imaging devices 121 and stores the image on which the image processing is executed into the memory device 150. A DSP, an LSI, an ASIC, an FPGA, or the like may be used in place of the processing circuit 170.

Figure 5:
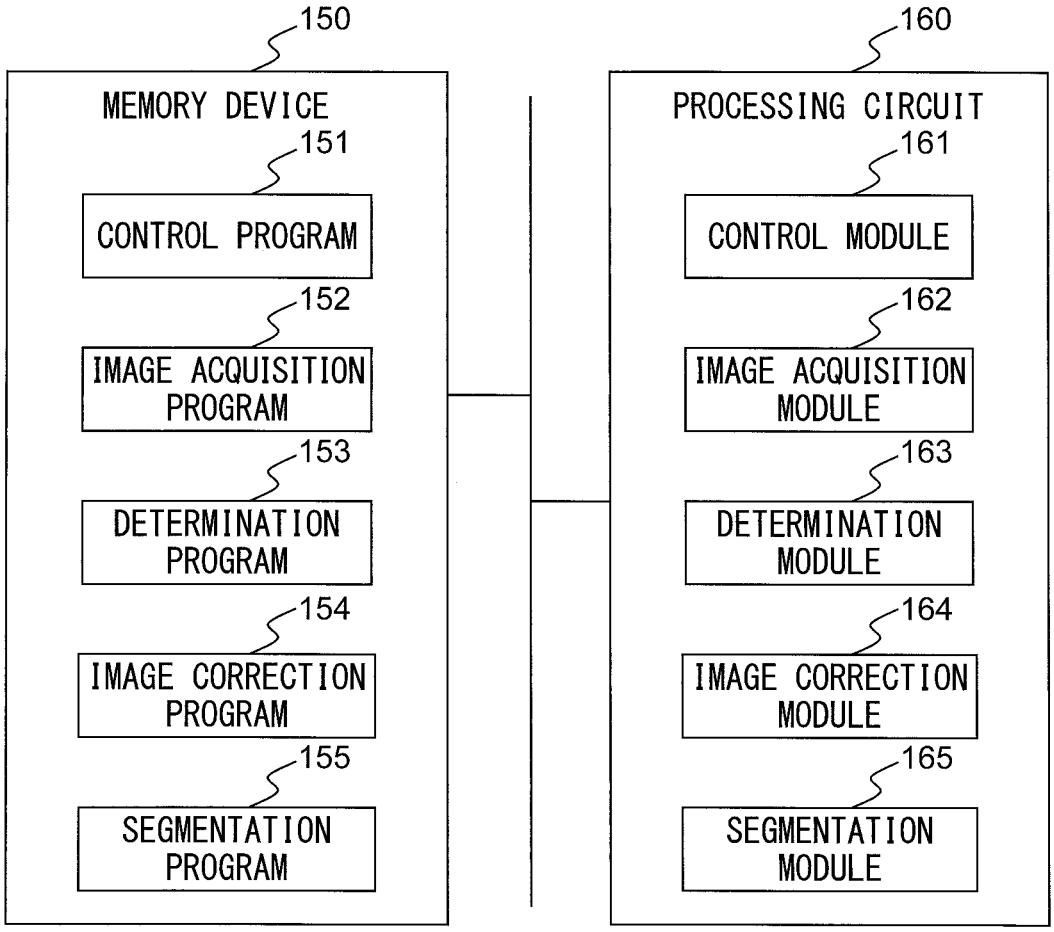
FIG. 5 is a diagram illustrating schematic configurations of a memory device 150 and a processing circuit 160.

FIG. 5 is a diagram illustrating schematic configurations of the memory device 150 and the processing circuit 160.

As illustrated in FIG. 5, the memory device 150 stores a control program 151, an image acquisition program 152, a determination program 153, an image correction program 154, a segmentation program 155, and the like. Each of these programs is a functional module implemented by software operating on a processor. The processing circuit 160 reads each program stored in the memory device 150 and operates in accordance with each read program. Consequently, the processing circuit 160 functions as a control module 161, an image acquisition module 162, a determination module 163, an image correction module 164, and a segmentation module 165.

Figure 6:
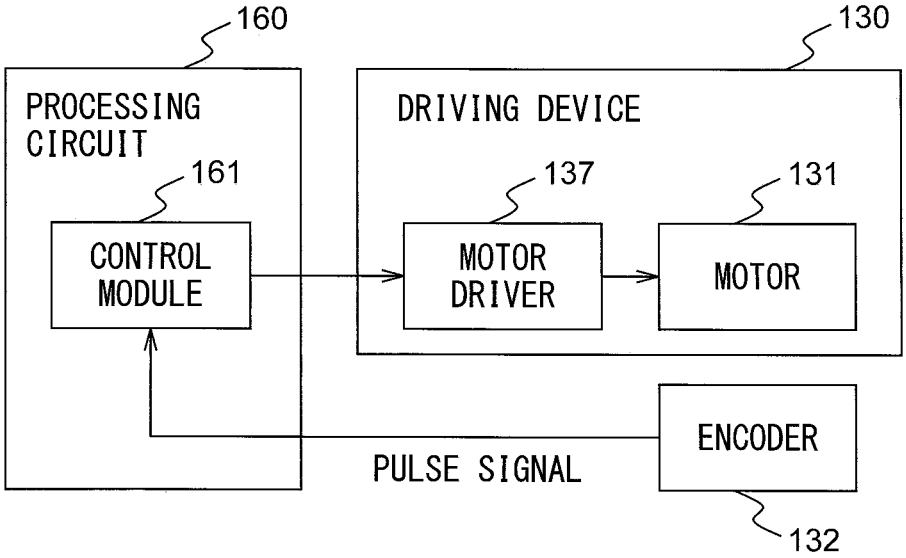
FIG. 6 is a diagram for illustrating control processing of the motor 131 by a control module 161.

FIG. 6 is a diagram for illustrating control processing of the motor 131 by the control module 161. The control module 161 drives the motor 131 by controlling a motor driver 137. The motor 131 is a DC motor. Further, for example, the motor driver 137 may be a motor driver circuit performing pulse width modulation (PWM) on a predetermined voltage providing a speed specified by the control module 161 and outputting the modulated voltage to the motor 131. The motor driver 137 may be integrated into the motor 131.

The control module 161 performs feedback control on the motor 131 in such a way that a rotation speed of the motor 131 follows a command value such as a previously set voltage value. The control module 161 acquires a cycle of a pulse signal output from the encoder 132 on a predetermined feedback control cycle (for example, at every 500 ns) and controls the motor driver 137 in such a way that a voltage value acquired by converting a frequency into voltage matches the command value. The encoder 132 is mounted on a rotation axis of the motor 131 and therefore outputs an encoder pulse related to a rotation speed of the motor 131. While a DC motor is low-cost and also allows simple speed adjustment, a rotation speed changes due to an external cause such as a load fluctuation. However, by the feedback control described above, the motor can be controlled in such a way as to have a rotation speed based on the command value after a predetermined period.

Figure 7:
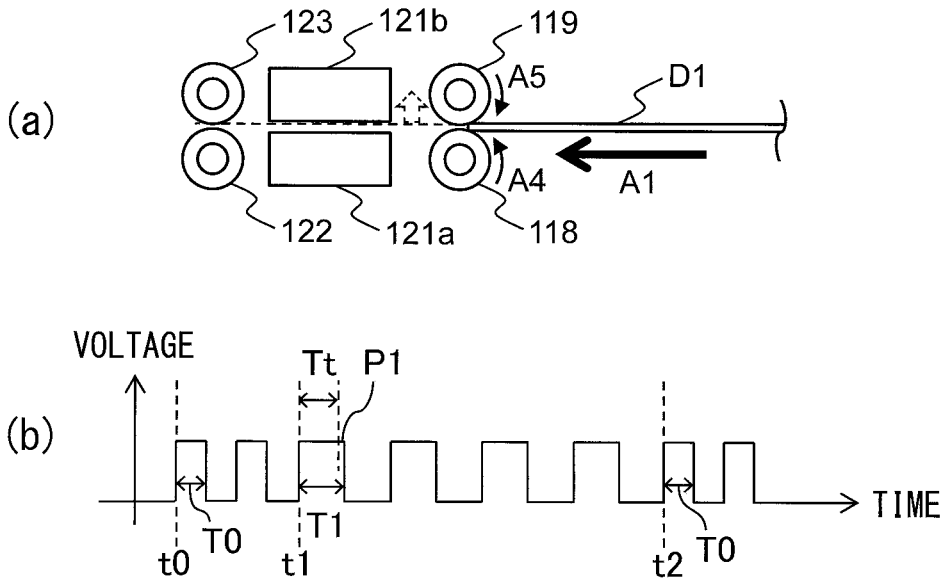
FIG. 7 is a diagram illustrating a state of a pulse width of a pulse signal output from the encoder 132 fluctuating due to a load fluctuation when a front edge part of a medium passes conveyance rollers.

FIG. 7(*a*) and FIG. 7(*b*) are diagrams illustrating a state in which a pulse width of a pulse signal output from the encoder 132 fluctuates due to a load fluctuation when a front edge part of a medium passes the conveyance rollers.

FIG. 7(*a*) illustrates a state in which a front edge part of a medium D1 fed by the feed rollers 112 is about to be fed between the first conveyance rollers 118 and the second conveyance rollers 119. At this time, the first conveyance rollers 118 rotate in the direction A4, and the second conveyance rollers 119 rotate in the direction A5; and a rotation speed of the motor 131 fluctuates by the load fluctuation when the first conveyance rollers 118 and the second conveyance rollers 119 pinch the front edge part of the medium D1.

FIG. 7(*b*) illustrates a state in which a pulse width of a pulse signal output from the encoder 132 fluctuates according to the rotation speed of the motor 131. The horizontal axis in FIG. 7(*b*) indicates time, and the vertical axis in FIG. 7(*b*) indicates a magnitude of voltage of the pulse signal.

At a time t0 before the medium D1 is fed between the first conveyance rollers 118 and the second conveyance rollers 119, the rotation speed of the motor 131 is kept constant by feedback control by the control module 161, and therefore the pulse width of the pulse signal output from the encoder 132 is maintained at a mostly constant pulse width T0.

When the first conveyance rollers 118 and the second conveyance rollers 119 pinch the front edge part of the medium D1 at a time t1, the rotation speed of the motor 131 slows down due to the load fluctuation, and the pulse width of the pulse signal P1 becomes a pulse width T1, exceeding a predetermined threshold value Tt. Even when the pulse width of the pulse signal P1 changes to the pulse width T1 at the time t1, the feedback control is not immediately exerted, and therefore the rotation speed of the motor 131 does not return to the former speed for a certain while; and accordingly, the pulse width remains at the pulse width T1 for a certain while.

In the example in FIG. 7(*b*), at a time t2 after a predetermined feedback control cycle, the pulse width of the pulse signal output from the encoder 132 is returned to the former pulse width T0.

Thus, although the pulse width of the pulse signal output from the encoder 132 temporarily fluctuates due to the load fluctuation when the first conveyance rollers 118 and the second conveyance rollers 119 pinch the front edge part of the medium D1, the width returns to the pulse width before the fluctuation by the feedback control.

The second conveyance rollers 119, the second imaging device 121*b*, and the fourth conveyance rollers 123 located above the conveyance path are provided to be able to move upward and move upward according to a thickness of the conveyed medium D1. The medium D1 fed under reading surfaces of the first imaging device 121*a* and the second imaging device 121*b* by the first conveyance rollers 118 and the second conveyance rollers 119 is read by the first imaging device 121*a* and the second imaging device 121*b*.

When the front edge part of the medium D1 passes the third conveyance rollers 122 and the fourth conveyance rollers 123 while the first imaging device 121*a* and the second imaging device 121*b* read the medium D1, the pulse width of the pulse signal similarly fluctuates due to the load fluctuation. Further, when a rear edge part of the medium passes the first conveyance rollers 118, the second conveyance rollers 119, the third conveyance rollers 122, and the fourth conveyance rollers 123, the pulse width of the pulse signal similarly fluctuates due to the load fluctuation.

Figure 8:
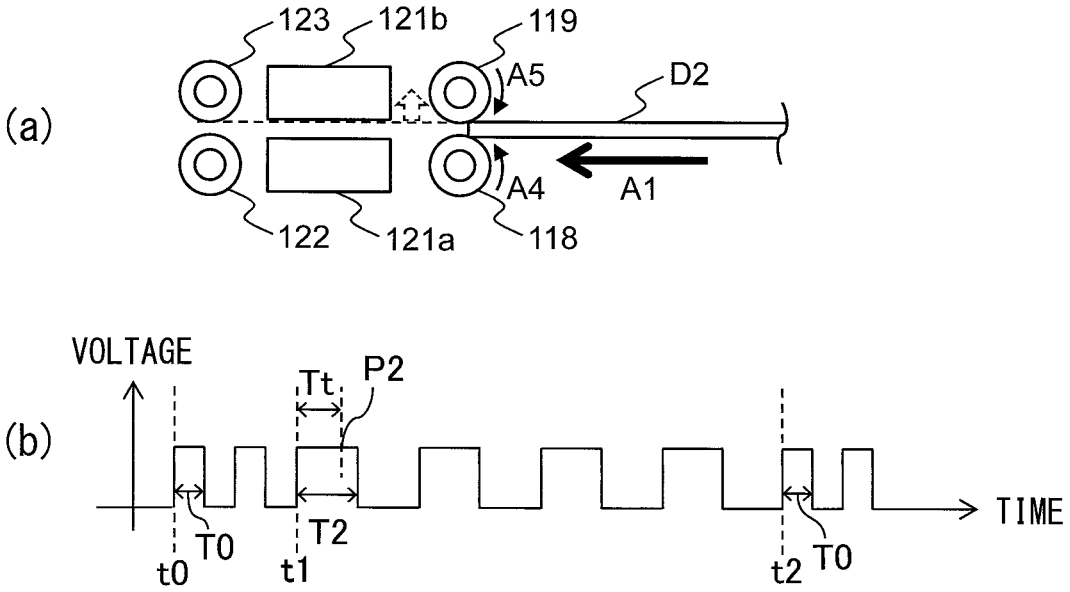
FIG. 8 is another diagram illustrating a state of a pulse width of a pulse signal output from the encoder 132 fluctuating due to a load fluctuation when a front edge part of a medium passes the conveyance rollers.

FIG. 8(*a*) and FIG. 8(*b*) are other diagrams illustrating a state in which a pulse width of a pulse signal output from the encoder 132 fluctuates due to a load fluctuation when a front edge part of a medium passes the conveyance rollers. A medium D2 in FIG. 8(*a*) and FIG. 8(*b*) is thicker compared with the medium D1 in FIG. 7(*a*) and FIG. 7(*b*).

As illustrated in FIG. 8(*a*), as a thickness of the medium D2 increases, a load fluctuation when the first conveyance rollers 118 and the second conveyance rollers 119 pinch the medium D2 increases. Consequently, as illustrated in FIG. 8(*b*), when the first conveyance rollers 118 and the second conveyance rollers 119 pinch the front edge part of the medium D2 at a time t1, the rotation speed of the motor 131 becomes slower, and the pulse width of the pulse signal P2 becomes a pulse width T2 greater than the pulse width T1.

Thus, a magnitude of a fluctuation of the pulse width of the pulse signal when the medium passes the conveyance rollers varies depending on the thicknesses of the conveyed media D1 and D2. Accordingly, the medium conveying apparatus 100 can determine the thicknesses of the media D1 and D2 on the basis of the fluctuation of the pulse width of the pulse signal due to the load fluctuation when each of the media D1 and D2 is conveyed.

Figure 9:
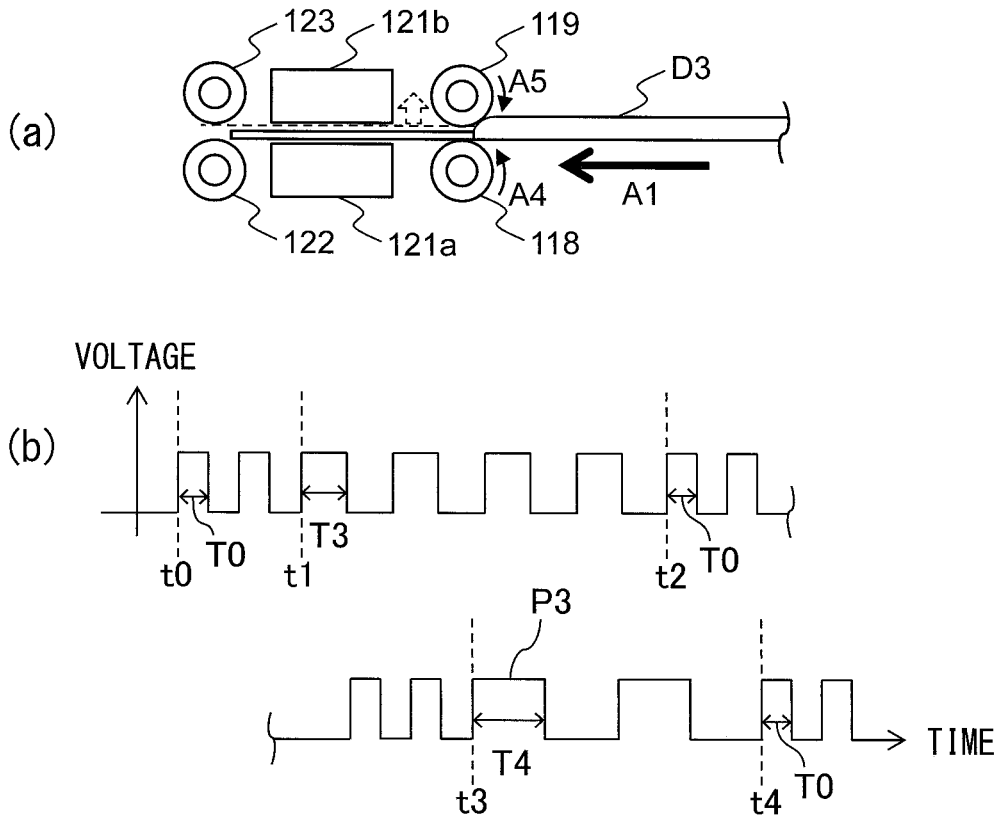
FIG. 9 is yet another diagram illustrating a state of a pulse width of a pulse signal output from the encoder 132 fluctuating due to a load fluctuation when a medium passes the conveyance rollers.

FIG. 9(*a*) and FIG. 9(*b*) are yet other diagrams illustrating a state in which a pulse width of a pulse signal output from the encoder 132 fluctuates due to a load fluctuation when a medium passes the conveyance rollers. FIG. 9(*a*) and FIG. 9(*b*) differ from FIG. 7(*a*) and FIG. 7(*b*) in that a medium D3 includes a plurality of regions with different thicknesses such as a passport a page of which including a photograph is opened and read.

The medium D3 illustrated in FIG. 9(*a*) is an example of a medium including regions with different thicknesses and includes a first region with a relatively small thickness (the left side in the diagram) and a second region with a relatively large thickness (the right side in the diagram). FIG. 9(*a*) illustrates a state in which the thick second region of the medium D3 is about to be fed between the first conveyance rollers 118 and the second conveyance rollers 119 after the thin first region of the medium D3 passes between the first conveyance rollers 118 and the second conveyance rollers 119. In the state illustrated in FIG. 9(*a*), the first imaging device 121*a* and the second imaging device 121*b* are reading the thin first region of the medium D3.

A waveform of a pulse signal in a period from a time t0 to a time t2 during which the thin first region of the medium D3 passes between the first conveyance rollers 118 and the second conveyance rollers 119 is the same as FIG. 7(*b*) except that a pulse width is a pulse width T3.

Subsequently, when the first conveyance rollers 118 and the second conveyance rollers 119 pinch the thick second region of the medium D3 at a time t3, the rotation speed of the motor 131 slows down due to the load fluctuation, and the pulse width of the pulse signal P3 becomes a pulse width T4 greater than the pulse width T3. Subsequently the pulse width of the pulse signal is returned to the pulse width T0 by the feedback control at a time t4.

Thus, even when the medium D3 includes a plurality of regions with different thicknesses, the medium conveying apparatus 100 can detect that the thickness of the medium changes, on the basis of the fluctuation of the pulse width of the pulse signal output from the encoder 132.

Figure 10:
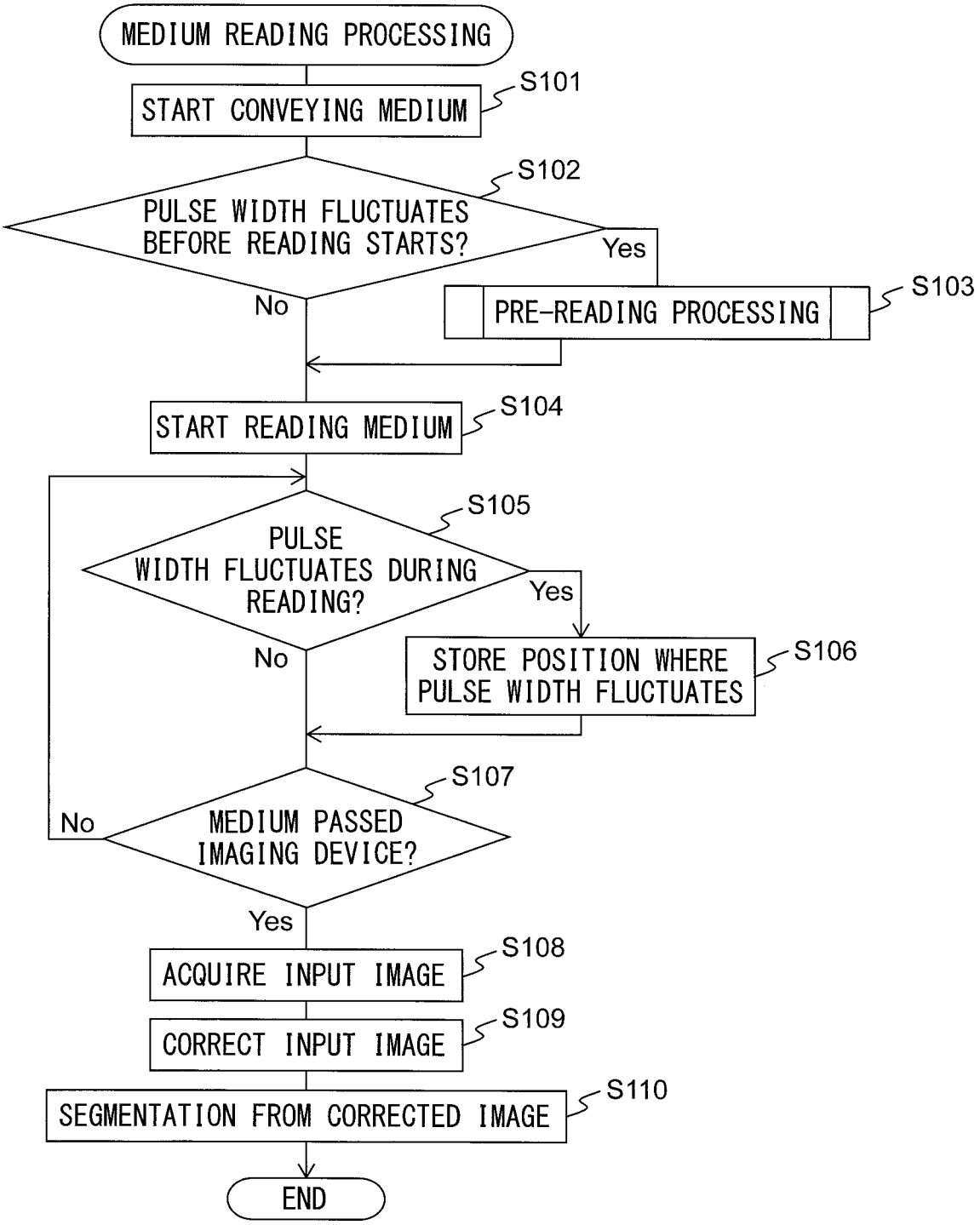
FIG. 10 is a flowchart illustrating an example of medium reading processing.

FIG. 10 is a flowchart illustrating an operation example of medium reading processing by the medium conveying apparatus 100. Referring to the flowchart illustrated in FIG. 10, the operation example of the medium reading processing in the medium conveying apparatus 100 will be described below. The operation flow described below is executed mainly by the processing circuit 160 in cooperation with each element in the medium conveying apparatus 100 in accordance with a program previously stored in the memory device 150. The operation flow illustrated in FIG. 10 is periodically executed.

First, the control module 161 rotates the feed rollers 112 by driving the driving device 130 and starts feeding a medium placed on the loading tray 103 (step S101).

Next, before the imaging devices 121 start imaging the medium, the control module 161 determines whether or not a pulse width of a pulse signal output from the encoder 132 fluctuates in such a way as to exceed a predetermined threshold value Tt (step S102). When the pulse width of the pulse signal fluctuates, the control module 161 executes pre-reading processing (step S103). The pre-reading processing will be described later (see FIG. 11).

Next, the image acquisition module 162 determines that the front edge of the medium passes a position of the second medium detection sensor 120 when a signal value of a signal output from the second medium detection sensor 120 changes from a value indicating nonexistence of a medium to a value indicating existence of a medium. Then, the image acquisition module 162 causes the imaging devices 121 to start reading the medium (step S104).

Next, while the imaging devices 121 are reading the medium, the control module 161 determines whether or not the pulse width of the pulse signal output from the encoder 132 fluctuates in such a way as to exceed the predetermined threshold value Tt (step S105). When the pulse width of the pulse signal fluctuates, the control module 161 stores a position of an imaging signal on an input image, the imaging signal being imaged when the pulse width of the pulse signal fluctuates, into the memory device 150 (step S106).

Next, the control module 161 determines whether or not the medium passes reading surfaces of the imaging devices 121 (step S107). For example, the control module 161 determines that the medium passes the imaging devices 121 when a predetermined period elapses after the signal value of the signal output from the second medium detection sensor 120 changes from the value indicating nonexistence of a medium to the value indicating existence of a medium. The control module 161 repeats step S105 to step S107 until the medium passes the imaging devices 121.

When the medium passes the imaging devices 121, the image acquisition module 162 causes the imaging devices 121 to end the reading of the medium and acquires an input image (step S108).

Next, the image correction module 164 generates a corrected image by correcting the input image (step S109). Correction processing of the input image will be described later [see FIG. 12(*a*)].

Next, the segmentation module 165 segments a region of the medium or a predetermined region on the medium from the corrected image generated by the image correction module 164 (step S110) and ends the series of processing. The processing of segmenting a predetermined region will be described later [see FIG. 12(*b*)].

In the example in FIG. 10, the image correction processing and the processing of segmenting a predetermined region are performed on the medium conveying apparatus 100 side; however, the image correction processing and/or the processing of segmenting a predetermined region may be executed by the information processing apparatus 200. In this case, the control module 161 transmits the input image and/or the corrected image, thickness information about the medium, to be described later, and information about a region where the load fluctuation has occurred to the information processing apparatus 200 through the interface device 142. The medium conveying apparatus 100 may only generate an input image and may not perform the image correction processing and the processing of segmenting a predetermined region, that is, may omit steps S109 and S110 in FIG. 10.

Figure 11:
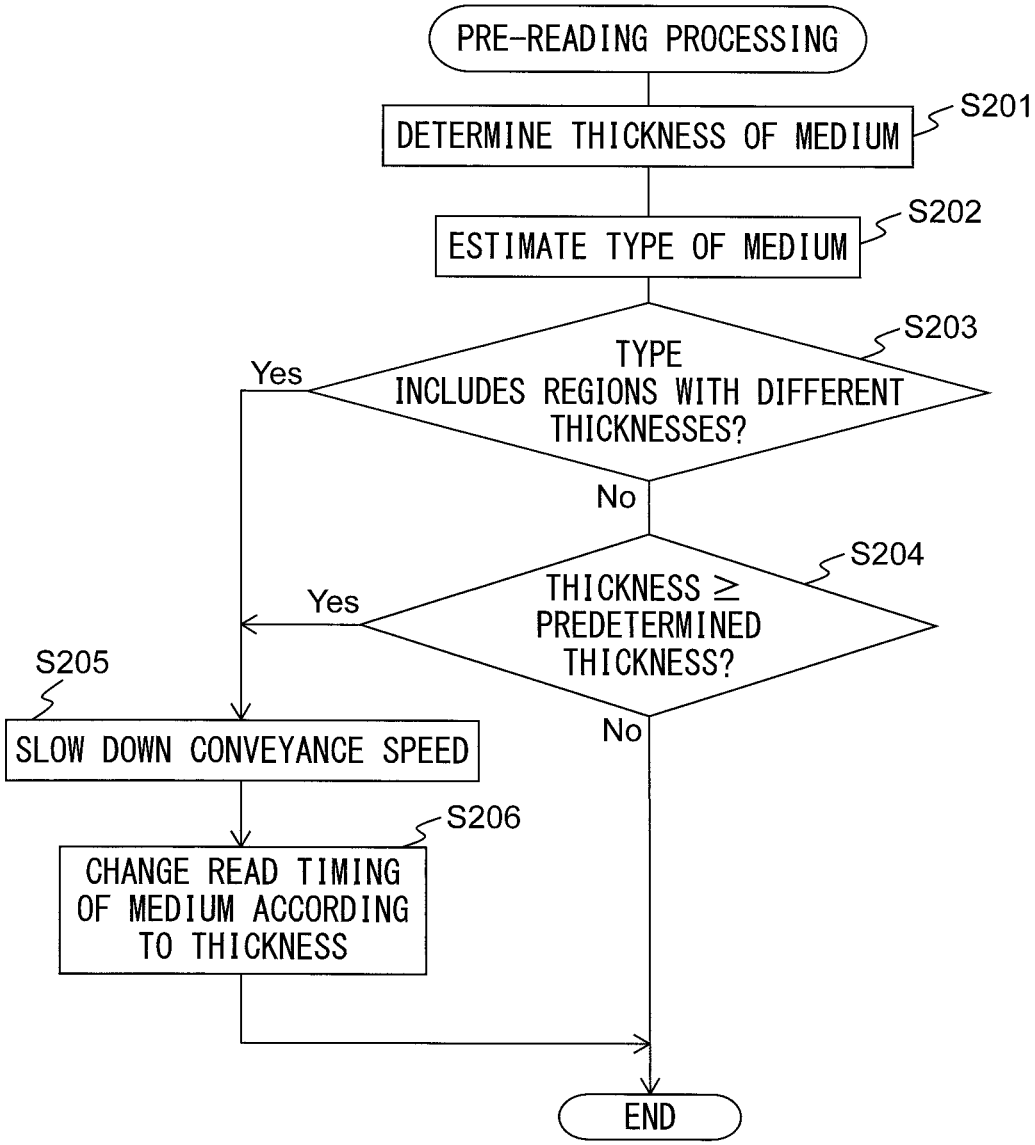
FIG. 11 is a flowchart illustrating an example of pre-reading processing.

FIG. 11 is a flowchart illustrating an operation example of the pre-reading processing in step S103 in FIG. 10.

The determination module 163 detects the fluctuation of the pulse width caused by the load fluctuation when the medium is conveyed, and determine a thickness of the medium according to the pulse width (step S201). For example, the determination module 163 may determine the thickness of the medium according to the pulse width T1 of the pulse signal P1 when the pulse width first exceeds the predetermined threshold value Tt as illustrated in FIG. 7(*b*). For that purpose, for example, the determination module 163 may previously store a table storing a pulse width and a thickness of a medium related to the pulse width in association with one another in the memory device 150 and determine the thickness of the medium by referring to the table. The table is prepared on the basis of actual measurements or the like of conveyance processing previously performed with varying medium thicknesses.

Next, the control module 161 estimates a type of the medium on the basis of the medium thickness determined by the determination module 163 (step S202). For example, the determination module 163 may previously store a table storing a medium thickness and a medium type related to the medium thickness in association with one another in the memory device 150 and estimate the medium type by referring to the table. The table is prepared on the basis of actual measurements or the like of conveyance processing previously performed with varying medium types.

Next, the control module 161 determines whether or not the medium type estimated by the determination module 163 is a type including a plurality of regions with different thicknesses such as a passport a page of which including a photograph is opened and read (step S203). The estimation of a medium type and the estimation of a type including regions with different thicknesses in steps S202 and S203 may be used in the image correction processing [see FIG. 12(*a*)] and the processing of segmenting a predetermined region [see FIG. 12(*b*)], to be described later.

When the medium type is determined not to be a type including a plurality of regions with different thicknesses in step S203, the control module 161 determines whether or not the medium thickness determined by the determination module 163 is greater than or equal to a predetermined thickness (step S204).

When the medium type is a type including a plurality of regions with different thicknesses or the medium thickness is greater than or equal to the predetermined thickness, the control module 161 controls the motor 131 in such a way that a medium conveyance speed becomes slower (step S205). Consequently, a load fluctuation when a boundary part of the medium where the thickness changes passes the first conveyance rollers 118, the second conveyance rollers 119, the third conveyance rollers 122, and the fourth conveyance rollers 123 while the medium is being read, as illustrated in FIG. 9(*a*), is reduced. Further, a load fluctuation when a thick medium is conveyed by the first conveyance rollers 118, the second conveyance rollers 119, the third conveyance rollers 122, and the fourth conveyance rollers 123 is reduced. The temporarily slowed down medium conveyance speed is controlled by the control module 161 in such a way as to be returned to the former conveyance speed at an appropriate timing such as a point in time when conveyance of the target medium is completed.

Next, the control module 161 changes a read timing of the medium in response to the slowdown of the conveyance speed (step S206). Specifically, the image acquisition module 162 performs control in such a way that an input image does not expand in the conveying direction even when the medium conveyance speed is slowed down, by changing a timing of acquiring a line image used for actual formation of an input image out of line images acquired by scanning the medium in a width direction on a predetermined cycle by the imaging devices 121. For example, in a case of a regular conveyance speed, an input image is formed by using every line image acquired by the imaging devices 121, whereas when the conveyance speed is slowed down, an input image is formed by use of (by thinning) only one out of three line images out of line images acquired by the imaging devices 121.

When the medium type is not a type including a plurality of regions with different thicknesses and also the medium thickness is less than the predetermined thickness, the control module 161 ends the pre-reading processing.

Figure 12:
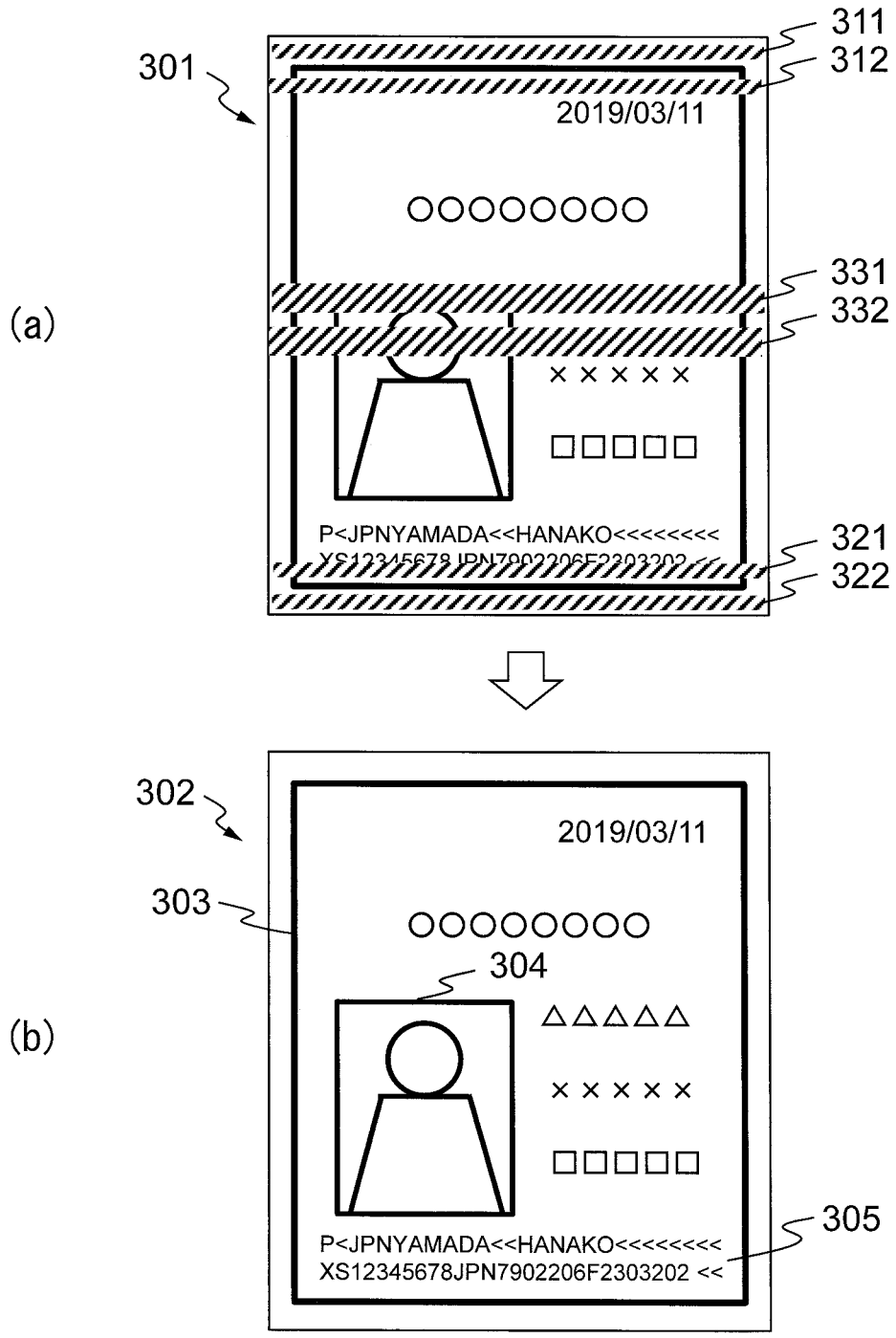
FIG. 12 is a diagram for illustrating correction processing of an input image in step S109 in FIG. 10.

FIG. 12(*a*) is a diagram for illustrating the correction processing of an input image 301 in step S109 in FIG. 10.

When a medium conveyance speed fluctuates due to a load fluctuation when a medium passes the first conveyance rollers 118, the second conveyance rollers 119, the third conveyance rollers 122, and the fourth conveyance rollers 123, a distortion such as expansion and contraction occurs on the input image 301. FIG. 12(*a*) illustrates an example of distortions 311, 312, 321, 322, 331, and 332 occurring on the input image 301 due to the load fluctuation when the medium is conveyed.

Each of the distortions 311 and 312 occurs due to a load fluctuation when a front edge part of the medium is fed between the first conveyance rollers 118 and the second conveyance rollers 119, and between the third conveyance rollers 122 and the fourth conveyance rollers 123.

Further, each of the distortions 321 and 322 occurs due to a load fluctuation when a rear edge part of the medium comes out from a space between the first conveyance rollers 118 and the second conveyance rollers 119, and a space between the third conveyance rollers 122 and the fourth conveyance rollers 123.

Further, each of the distortions 331 and 332 occurs due to a load fluctuation when a boundary part of the medium where a thickness changes passes between the first conveyance rollers 118 and the second conveyance rollers 119, and the third conveyance rollers 122 and the fourth conveyance rollers 123.

The image correction module 164 corrects the distortions 311, 312, 321, 322, 331, and 332 occurring on the input image 301 on the basis of, for example, a medium type estimated from a medium thickness in step S202 in FIG. 11. For example, the image correction module 164 previously stores a table storing a medium type, a region where a distortion occurs on the input image 301 when the medium type is read, and an expansion ratio for correcting the region in association with one another in the memory device 150. The table is prepared on the basis of actual measurements or the like of reading processing previously performed with varying medium types. Then, the image correction module 164 may refer to the table and correct the input image 301 by expanding or contracting a region where a distortion occurs on the input image 301 when the medium type is read, at an expansion ratio for correcting the region.

Further, the image correction module 164 may refer to information about a position of an imaging signal on the input image 301, the imaging signal being imaged when a pulse width of a pulse signal fluctuates, the position being stored in step S106 in FIG. 10, and may correct an input image related to a region where the thickness changes. Consequently, a distortion of an input image is more accurately corrected.

FIG. 12(*b*) is a diagram for illustrating the processing of segmenting a predetermined region in step S110 in FIG. 10. An image illustrated in FIG. 12(*b*) is an example of a corrected image 302 corrected by the image correction module 164. In the corrected image 302 illustrated in FIG. 12(*b*), a boundary of a medium region 303 and a boundary of a predetermined region 304 such as a photograph region of a passport are clarified by the distortions 311, 312, 321, 322, 331, and 332 illustrated in FIG. 12(*a*) being corrected. Further, a boundary of a predetermined region 305 readable by optical character recognition (OCR) or the like, such as a machine readable zone (MRZ) provided on a passport, is also clarified. Consequently, the segmentation module 165 can accurately segment the clarified medium region 303 and the clarified predetermined regions 304 and 305.

As described above, the medium conveying apparatus 100 includes the motor 131 driving the conveyance rollers conveying a medium, the control module 161 rotating the conveyance rollers by controlling the motor 131, and a signal output device for outputting a pulse signal a pulse width of which changes according to a rotation speed of the motor 131. Then, the determination module 163 detects the fluctuation of the pulse width based on the load fluctuation when the conveyance rollers convey the medium and determines a thickness of the medium conveyed by the conveyance rollers. Consequently, the medium conveying apparatus 100 can detect a thickness of a conveyed medium with a simple configuration.

Further, the determination module 163 determines a medium thickness on the basis of a pulse width of a pulse signal when the pulse width first exceeds a predetermined threshold value. Consequently, the medium conveying apparatus 100 can rapidly calculate a thickness of a conveyed medium with a small amount of computation.

Further, when a medium thickness determined by the determination module 163 is greater than or equal to a predetermined thickness, the control module 161 controls the motor 131 in such a way as to slow down rotation speeds of the conveyance rollers compared with a case of the medium thickness being less than the predetermined thickness. Consequently, a load fluctuation when a thick medium is conveyed by the first conveyance rollers 118, the second conveyance rollers 119, the third conveyance rollers 122, and the fourth conveyance rollers 123 is reduced.

Further, when an estimated medium type is a type including a plurality of regions with different thicknesses, the control module 161 controls the motor 131 in such a way as to slow down the rotation speeds of the conveyance rollers compared with a case of the medium type not being a type including a plurality of regions with different thicknesses. Consequently, a load fluctuation when a boundary part where a medium thickness changes passes the first conveyance rollers 118, the second conveyance rollers 119, the third conveyance rollers 122, and the fourth conveyance rollers 123 while the medium is being read is reduced.

Further, the control module 161 controls a rotation speed of a DC motor in such a way that a pulse width follows a command value. Consequently, a medium conveyance speed is stabilized by feedback control. Further, quietness is improved and power consumption is reduced, compared with a case of using a stepping motor.

Further, the determination module 163 detects a fluctuation of a pulse width before the imaging device starts reading a medium, and determines a thickness of the medium. Consequently, the medium conveying apparatus 100 can slow down a medium conveyance speed or change a read timing of the medium before the imaging devices 121 start imaging the medium.

Further, the imaging device changes a read timing of a medium according to a medium thickness determined by the determination module 163. Consequently, the control module 161 suppresses expansion of an input image in a height direction due to a slowdown of a medium conveyance speed when the medium is thick.

Further, the determination module 163 detects a fluctuation of a pulse width while the imaging device is reading a medium and detects a region where a medium thickness changes; and the image correction module 164 corrects an input image related to the region where the thickness changes detected by the determination module 163. Consequently, a distortion of an input image is more accurately corrected.

Further, the segmentation module 165 segments a predetermined region from an input image corrected by the image correction module 164. Consequently, a medium region and a predetermined region clarified by the correction are accurately segmented.

Every embodiment described above merely represents a materialization example at implementation, and the technical scope shall not be interpreted in a limited manner. In other words, various forms may be implemented without departing from the technical concept or main features thereof.

Figure 13:
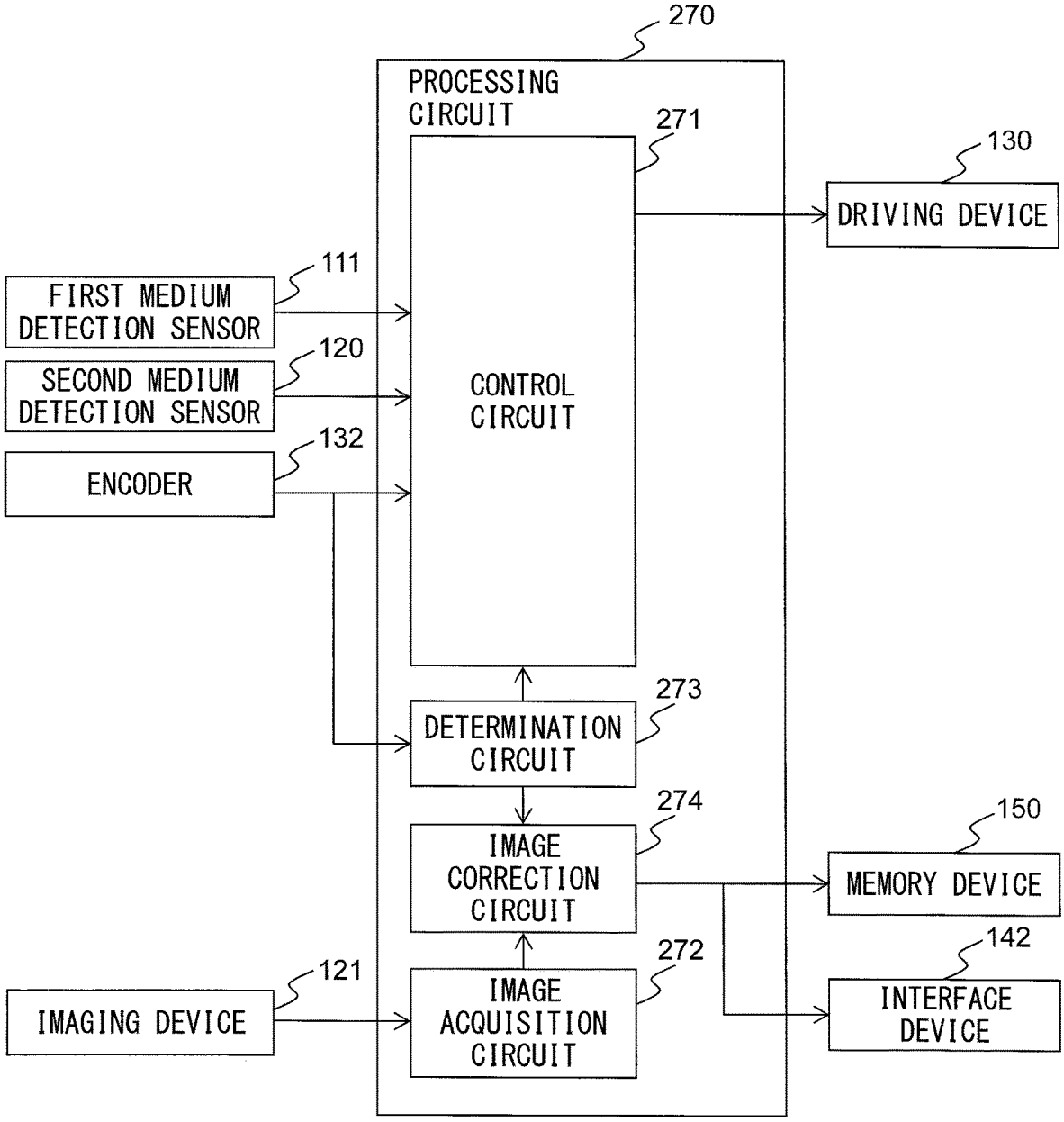
FIG. 13 is a diagram illustrating a schematic configuration of a processing circuit 270 in a medium conveying apparatus 100 according to another embodiment.

FIG. 13 is a diagram illustrating a schematic configuration of a processing circuit 270 in a medium conveying apparatus according to another embodiment. The processing circuit 270 is used in place of the processing circuit 160 in the medium conveying apparatus 100 and executes the medium reading processing, the determination processing, and the image correction processing in place of the processing circuit 160. The processing circuit 270 includes a control circuit 271, an image acquisition circuit 272, a determination circuit 273, and an image correction circuit 274.

The control circuit 271 is an example of a control module and has a function similar to the control module 161. The image acquisition circuit 272 is an example of an image acquisition module and has a function similar to the image acquisition module 162. The determination circuit 273 is an example of a determination module and has a function similar to the determination module 163. The image correction circuit 274 is an example of an image correction module and has a function similar to the image correction module 164.

Each part included in the processing circuit may be independently configured with an integrated circuit, a microprocessor, firmware, etc. Further, some parts included in the processing circuit may be configured with a circuit, and other parts may be configured with a functional module implemented by software operating on a processor.

Figure 14:
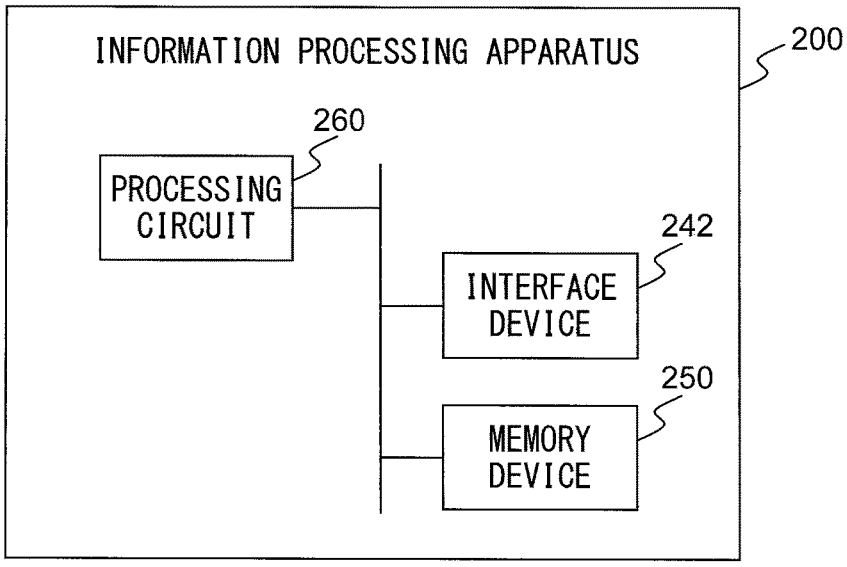
FIG. 14 is a block diagram illustrating a schematic configuration of an information processing apparatus 200 according to the other embodiment.

Further, FIG. 14 is a block diagram illustrating a schematic configuration of an information processing apparatus 200 according to the other embodiment. In an image processing system 1 including the medium conveying apparatus 100 and the information processing apparatus 200, the information processing apparatus 200 may have functions equivalent to the image correction module 164 and the segmentation module 165 in the medium conveying apparatus 100. The information processing apparatus 200 includes an interface device 242, a memory device 250, and a processing circuit 260.

For example, the interface device 242 includes an interface circuit conforming to a serial bus such as USB, is electrically connected to the medium conveying apparatus 100, and transmits and receives an input image and various types of information. Further, a communication unit including an antenna transmitting and receiving wireless signals, and a wireless communication interface device for transmitting and receiving signals through a wireless communication line in conformance with a predetermined communication protocol may be used in place of the interface device 242. For example, the predetermined communication protocol is a wireless LAN.

The memory device 250 includes a memory device such as a RAM or a ROM, a fixed disk device such as a hard disk, or a portable storage device such as a flexible disk or an optical disk. Further, the memory device 250 stores a computer program, a database, a table, and the like used for various types of processing in the information processing apparatus 200. The computer program may be installed on the memory device 250 from a computer-readable portable recording medium by use of a known setup program or the like. For example, the portable recording medium is a CD-ROM, a DVD-ROM, or the like.

For example, the processing circuit 260 is a processor, such as a central processing unit (CPU). The processing circuit 260 operates in accordance with a program previously stored in the memory device 250. The processing circuit 260 may be a DSP, an LSI, an ASIC, an FPGA, etc. The processing circuit 260 is connected to the interface device 242, the memory device 250, and the like, and controls each of these units. The processing circuit 260 receives an image from the medium conveying apparatus 100 through the interface device 242, executes processing similarly to the image correction module 164 and the segmentation module 165 in the medium conveying apparatus 100, and stores the processed image into the memory device 250.

Figure 15:
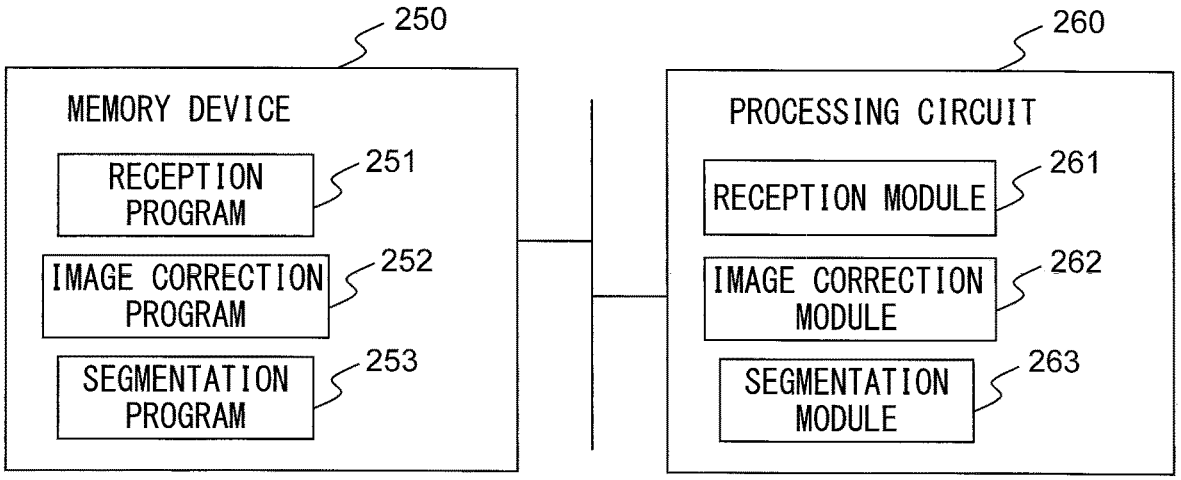
FIG. 15 is a diagram illustrating schematic configurations of a memory device and a processing circuit in the information processing apparatus 200 according to the other embodiment.

FIG. 15 is a diagram illustrating a schematic configuration of the memory device 250 and the processing circuit 260 in the information processing apparatus 200 according to the other embodiment. According to the present embodiment, the information processing apparatus 200 executes the image correction processing in place of the medium conveying apparatus 100.

As illustrated in FIG. 15, the memory device 250 stores programs such as a reception program 251, an image correction program 252, and a segmentation program 253. Each of these programs is a functional module implemented by software operating on a processor. The processing circuit 260 reads each program stored in the memory device 250 and operates in accordance with each read program. Consequently, the processing circuit 260 functions as a reception module 261, an image correction module 262, and a segmentation module 263.

The reception module 261 receives an input image from the medium conveying apparatus 100 through the interface device 242. The image correction module 262 generates a corrected image by correcting the input image. The segmentation module 165 segments a medium region or a predetermined region on the medium from the corrected image.

The image processing system according to the present embodiment can also provide effects similar to the effects described above.

According to this embodiment, the medium conveying apparatus, the method, and the computer-readable, non-transitory medium storing the control program can detect a thickness of a conveyed medium with a simple configuration.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A medium conveying apparatus comprising:
a conveyance roller to convey a medium;
a motor to drive the conveyance roller;
a signal generator to output a pulse signal, a pulse width of which changes according to a rotation speed of the motor; and
a processor to
rotate the conveyance roller by controlling the motor;
detect a fluctuation of the pulse width caused by a load fluctuation when the conveyance roller conveys the medium; and
determine a thickness of the medium according to the pulse width.

2. The medium conveying apparatus according to claim 1, wherein the processor determines the thickness of the medium according to the pulse width of a pulse signal when the pulse width first exceeds a predetermined threshold value.

3. The medium conveying apparatus according to claim 1, wherein, when the thickness of the medium determined by the processor is greater than or equal to a predetermined thickness, the processor controls the motor in such a way as to slow down a rotation speed of the conveyance roller compared with a case of the thickness of the medium being less than the predetermined thickness.

4. The medium conveying apparatus according to claim 1, wherein
the processor estimates a type of the medium on a basis of the thickness of the medium, and,
when the estimated type of the medium is a type including a plurality of regions with different thicknesses, the processor controls the motor in such a way as to slow down a rotation speed of the conveyance roller compared with a case of the estimated type of the medium not being a type including a plurality of regions with different thicknesses.

5. The medium conveying apparatus according to claim 1, wherein
the motor is a DC motor, and
the processor controls a rotation speed of the DC motor in such a way that the pulse width follows a command value.

6. The medium conveying apparatus according to claim 1, further comprising an imaging device to generate an input image by imaging the medium, wherein
the processor detects the fluctuation of the pulse width before the imaging device starts reading the medium, and wherein
the processor determines the thickness of the medium before the imaging device starts reading the medium.

7. The medium conveying apparatus according to claim 1, further comprising an imaging device to generate an input image by imaging the medium, wherein
the imaging device changes a read timing of the medium according to the thickness of the medium.

8. The medium conveying apparatus according to claim 1, further comprising:
an imaging device to generate an input image by imaging the medium, wherein
the processor detects the fluctuation of the pulse width while the imaging device is reading the medium, and detects a region where the thickness of the medium changes, and wherein
the processor corrects the input image related to the region.

9. The medium conveying apparatus according to claim 8, wherein the processor segments a predetermined region from the input image corrected by the processor.

10. A method for determining a thickness of a medium, comprising:
rotating a conveyance roller to convey a medium by controlling a motor to drive the conveyance roller;
outputting a pulse signal, a pulse width of which changes according to a rotation speed of the motor;
detecting a fluctuation of the pulse width caused by a load fluctuation when the conveyance roller conveys the medium; and
determining a thickness of the medium according to the pulse width.

11. The method according to claim 10, wherein the thickness of the medium is determined according to the pulse width of a pulse signal when the pulse width first exceeds a predetermined threshold value, in the determining step.

12. The method according to claim 10, further comprising, when the thickness of the medium is greater than or equal to a predetermined thickness, controlling the motor in such a way as to slow down a rotation speed of the conveyance roller compared with a case of the thickness of the medium being less than the predetermined thickness.

13. The method according to claim 10, further comprising:
estimating a type of the medium on a basis of the thickness of the medium; and
when the estimated type of the medium is a type including a plurality of regions with different thicknesses, controlling the motor in such a way as to slow down a rotation speed of the conveyance roller compared with a case of the estimated type of the medium not being a type including a plurality of regions with different thicknesses.

14. The method according to claim 10, wherein the motor is a DC motor, and further comprising controlling a rotation speed of the DC motor in such a way that the pulse width follows a command value.

15. The method according to claim 10, further comprising generating an input image by imaging the medium by an imaging device, wherein the fluctuation of the pulse width is detected before the imaging device starts reading the medium, in the detecting step, and wherein the thickness of the medium is determined before the imaging device starts reading the medium, in the determining step.

16. The method according to claim 10, further comprising:

generating an input image by imaging the medium by an imaging device; and changing a read timing of the medium by the imaging device according to the thickness of the medium.

17. The method according to claim 10, further comprising:

generating an input image by imaging the medium by an imaging device;

detecting the fluctuation of the pulse width while the imaging device is reading the medium;

detecting a region where the thickness of the medium changes; and correcting the input image related to the region.

18. The method according to claim 17, further comprising segmenting a predetermined region from the corrected input image.

19. A computer-readable, non-transitory medium storing a computer program, wherein the computer program causes a medium conveying apparatus including a conveyance roller to convey a medium, a motor to drive the conveyance roller, a signal generator to output a pulse signal, a pulse width of which changes according to a rotation speed of the motor, to execute a process, the process comprising:

rotating the conveyance roller by controlling the motor;

detecting a fluctuation of the pulse width caused by a load fluctuation when the conveyance roller conveys the medium; and determining a thickness of the medium according to the pulse width.

20. The medium according to claim 19, wherein the thickness of the medium is determined according to the pulse width of a pulse signal when the pulse width first exceeds a predetermined threshold value, in the determining step.

* * * * *